US008381614B1

(12) United States Patent
Somalingayya et al.

(10) Patent No.: US 8,381,614 B1
(45) Date of Patent: Feb. 26, 2013

(54) HANDLE APPARATUS

(75) Inventors: Veeresh Somalingayya, Secunderabad (IN); Sachin Tulsidas Thakkar, Hyderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/297,705

(22) Filed: Nov. 16, 2011

(51) Int. Cl.
*G05G 1/04* (2006.01)

(52) U.S. Cl. ..... 74/523

(58) Field of Classification Search ..... 74/519, 74/522.5, 523, 526; 200/252, 327, 332, 337
See application file for complete search history.

(56) References Cited

U.S. PATENT DOCUMENTS

| | | | | |
|---|---|---|---|---|
| 1,375,946 | A | | 4/1921 | White |
| 1,460,542 | A | | 7/1923 | Griswold |
| 1,588,211 | A | | 6/1926 | Van Amberg et al. |
| 1,928,487 | A | | 9/1933 | Hammerly |
| 2,316,977 | A | * | 4/1943 | Sauers ..... 200/318 |
| 3,301,989 | A | | 1/1967 | Ericson |
| 3,418,867 | A | * | 12/1968 | Maeda ..... 74/535 |
| 3,609,261 | A | * | 9/1971 | Rys ..... 200/50.15 |
| 4,162,878 | A | | 7/1979 | Puglisi et al. |
| 6,084,186 | A | | 7/2000 | Shaffer |
| 2010/0005922 | A1 | * | 1/2010 | Holland et al. ..... 74/526 |
| 2010/0133074 | A1 | | 6/2010 | Eppe et al. |
| 2011/0048905 | A1 | | 3/2011 | Li |

* cited by examiner

*Primary Examiner* — Vicky Johnson

(74) *Attorney, Agent, or Firm* — Cantor Colburn LLP

(57) ABSTRACT

An apparatus includes a linkage having an axis of rotation, a handle member being linked to the linkage, a stop member connected to the handle member, and a guide member defining an engagement region aligned with the stop member such that a portion of the stop member engages the engagement region.

15 Claims, 10 Drawing Sheets

HANDLE APPARATUS

BACKGROUND OF THE INVENTION

The subject matter disclosed herein relates to handle devices. A handle device may be attached to a fixture such as, for example, a box or access panel. The handle device may be mechanically linked to a device in the box, such as, for example, an electrical switching device. The handle may be partially exposed and disposed adjacent to an exterior portion of the box or access panel. In typical operation, an operator may change the position of the handle device without opening or accessing the interior space of the box and the access panel.

The partial exposure of the handle device adjacent to an exterior portion of the box or access panel may result in damage to the handle device during shipping or storage of the assembly.

BRIEF DESCRIPTION OF THE INVENTION

According to one aspect of the invention, an apparatus includes a linkage having an axis of rotation, a handle member being linked to the linkage, a stop member connected to the handle member, and a guide member defining an engagement region aligned with the stop member such that a portion of the stop member engages the engagement region.

According to another aspect of the invention an apparatus includes a linkage having an axis of rotation, a handle member being linked to the linkage, a guide member defining an engagement region, and a stop member linked to the handle member, the stop member defining longitudinal axis, the stop member including a biasing member that exerts a force on a portion of the stop member to extend the portion of the stop member to engage the engagement region.

According to yet another aspect of the invention an apparatus includes a panel having an outer surface and a region defined by the outer surface, and a handle device that includes a linkage having an axis of rotation, the linkage is arranged to pass through the region defined by the outer surface of the panel, a handle member being linked to the linkage, a stop member connected to the handle member, and a guide member defining an engagement region aligned with the stop member such that a portion of the stop member is configured to engage the engagement region defined by the guide member.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Panel assemblies that include handle assemblies disposed adjacent to an external surface of the panel assembly are often arranged such that a portion of the handle assembly is exposed relative to a surface of the panel assembly. In this regard, for example, a handle assembly may be arranged on a side panel of the panel assembly and a portion of the handle assembly may extend through or intersect a plane defined by a front panel of the panel assembly. The arrangement of the handle assembly may expose the handle assembly to damage during shipping or storage of the assembly. The exemplary embodiments described below allow the handle assembly to be placed in a position that reduces the profile of the assembly such that the handle assembly is less exposed to damage during shipping or storage.

Figure 1:
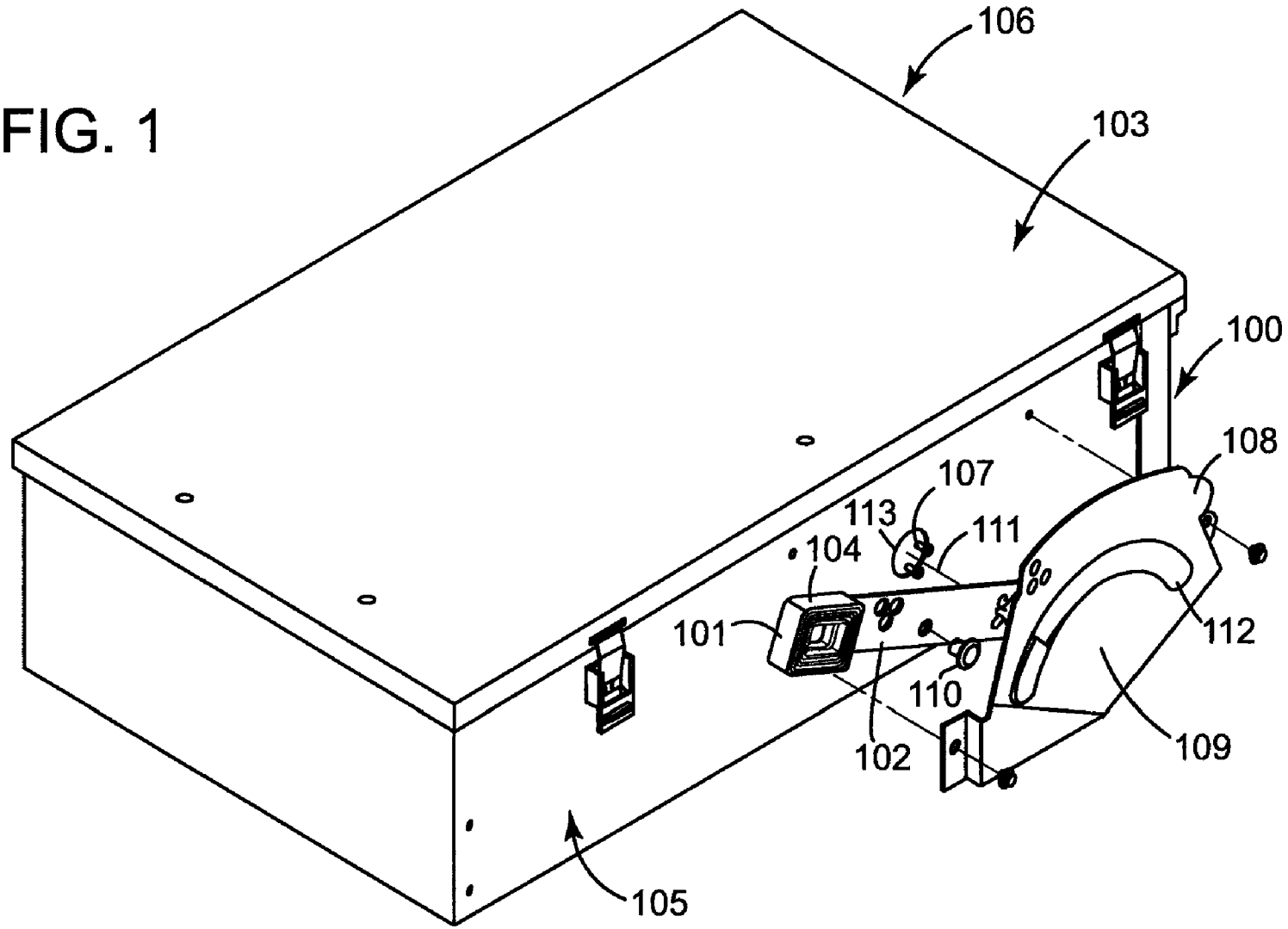
FIG. 1 illustrates a perspective exploded view of an exemplary embodiment of a handle assembly in accordance with an exemplary embodiment of the invention.

FIG. 1 illustrates a perspective exploded view of an exemplary embodiment of a handle assembly 100 that is operative to actuate a device (not shown) such as, for example, a switch disposed in a panel assembly 106 having a facing surface 103 and a side surface 105. The handle assembly 100 includes a handle member 102 that includes a grip region 104 arranged at a distal end 101 of the handle member 102. The handle member 102 may be mechanically linked to a device disposed in the panel assembly 106 with, for example fasteners 107 that define a portion of a linkage that passes through an engagement region 113 defined by the side surface 105. The handle member 102 is operative to pivot about an axis of rotation illustrated by the line 111 when torque is applied by an operator to the handle member 102. The handle assembly 100 includes a guide member 108 that may be connected to the side surface 105 of the panel assembly 106 with, for example, fasteners or another connective means. The guide member 108 includes a body portion 109 that partially shrouds or obscures portions of the handle member 102. The handle member 102 is disposed between body portion 109 of the guide member 108. The rotation of the handle member 102 defines a plane that is disposed between the side surface 105 of the panel assembly 106 and the body portion 109 of the guide member 108. The handle assembly 100 includes a stop member 110 that is operative to engage an arcuate shaped engagement region (e.g., an orifice) 112 defined by the guide member 108. Though the illustrated embodiment includes the engagement region 112 orifice, alternate embodiments may include the stop member 110 engaging a portion of guide member 108 that may include a slot, cut-out region, or recess. Thus, the term engagement region is not limiting to a region having a continuous interior boundary defined by the guide member 108, and may include, for example, a slot or recessed region that may partially define the impeding member 302

(described below) that engages the stop member 110. The engagement region 112 may be defined as a planar region substantially parallel to the plane defined by the rotation of the handle member 102 (i.e., a plane substantially orthogonal to the line 111. Though the illustrated embodiment shows the handle assembly 100 arranged on the side surface 105 of the panel assembly 106, the handle assembly 100 may be arranged on any surface of the panel assembly 106 in alternate exemplary embodiments.

Figure 2:
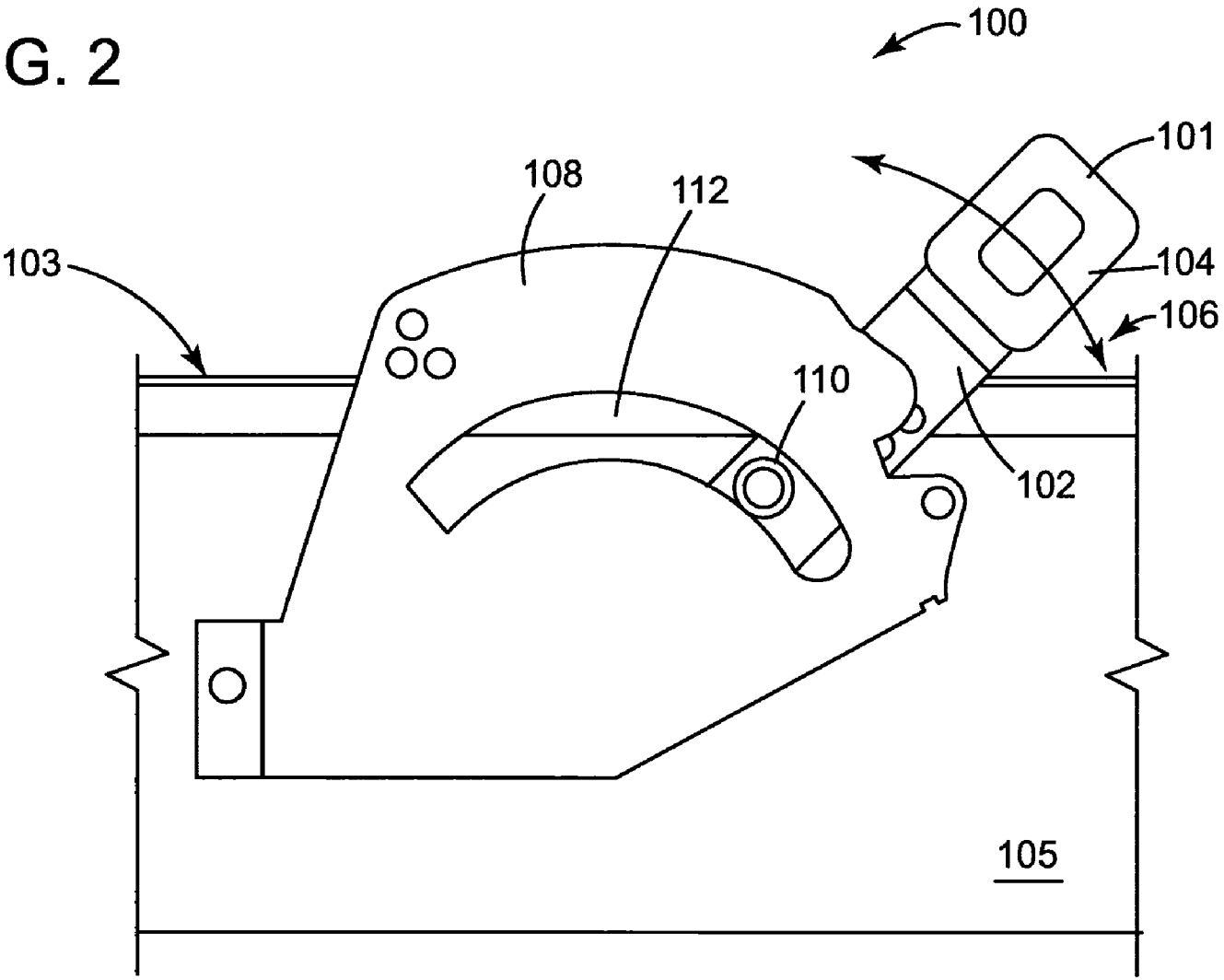
FIG. 2 illustrates a side view of the handle assembly of FIG. 1 with the handle member disposed in a first operational position.

FIG. 2 illustrates a side view of the handle assembly 100, with the handle member 102 disposed in a first operational position. In the illustrated embodiment, the first operational position, is a position where the device (not shown) such as, for example, a switch, that is linked to the handle member 102 is in an "on" or "closed" state. The stop member 110 is shown engaging the engagement region 112 of the guide member 108, where a portion of the stop member 110 passes through the engagement region 112. In the illustrated embodiment the handle member 102 is operative to pivot about an axis of rotation defined by the mechanical linkage of the device disposed in the panel assembly 106. The distal end 101 of the handle member 102 defines an arcuate path when moved by an operator.

Figure 3:
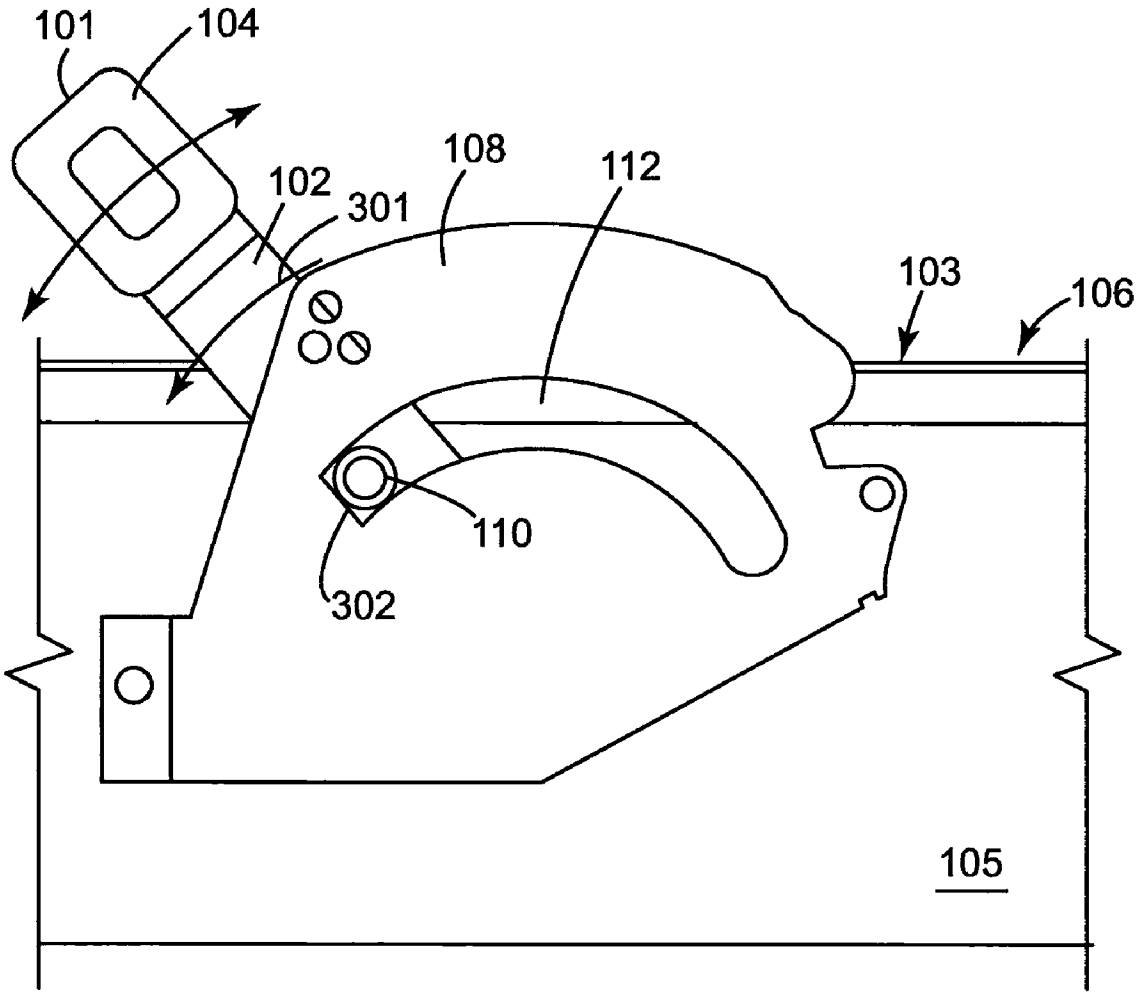
FIG. 3 illustrates a side view of the handle assembly of FIG. 1 with the handle member disposed in a second operational position.

FIG. 3 illustrates another side view of the handle assembly 100, with the handle member 102 disposed in a second operational position. In the illustrated embodiment, the second operational position is a position where the device (not shown) that is linked to the handle member 102 is in an "off" or "open" state. The stop member 110 is shown engaging the engagement region 112 and contacting an impeding portion 302 of the guide member 108 that partially defines the engagement region 112. The impeding portion 302 contacting the stop member 110 impedes the motion of the handle member 102 in the direction illustrated by the arrow 301. In the illustrated embodiments of FIGS. 2 and 3, the distal end 101 of the handle member 102 extends substantially parallel to a plane defined by the side surface 105 and beyond a plane defined by the facing surface 103. In operation, the extension (or exposure) of the distal end 101 (or grip region 104) of the handle member 102 beyond the plane defined by the facing surface 103 is desirable to facilitate the griping of the grip region 104 by an operator. The contact between the impeding portion 302 and the stop member 110 as shown in FIG. 3 helps to prevent an operator from unintentionally moving the grip region 104 beyond the operational range of motion of the handle member 102, and possibly, pinching an object between a portion of the panel assembly 106 and the handle member 102.

Figure 4:
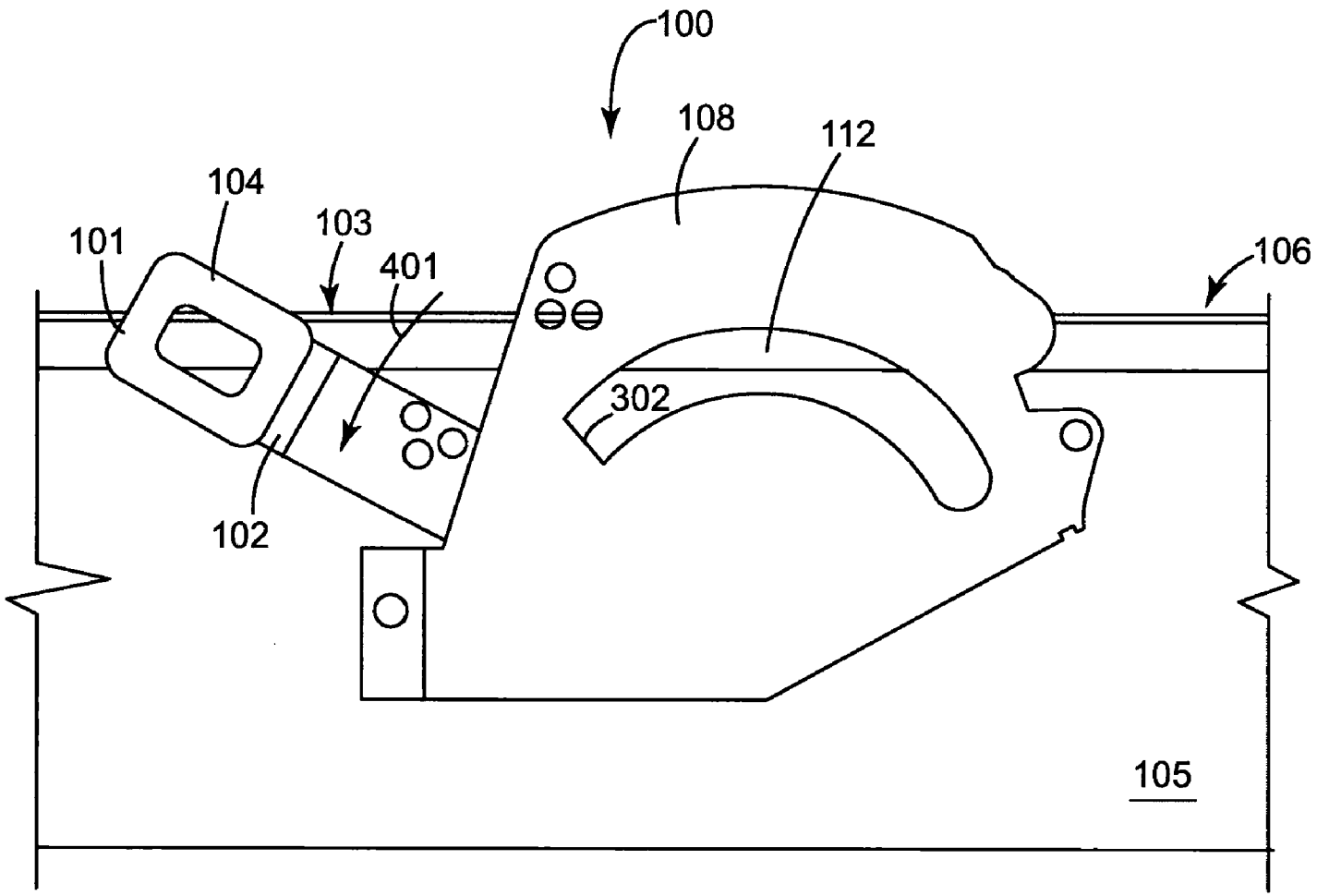
FIG. 4 illustrates a side view of the handle assembly of FIG. 1 with the handle member disposed in a shipping position.

FIG. 4 illustrates another side view of the handle assembly 100, with the handle member 102 disposed in a storage or shipping position. In the illustrated embodiment, the shipping position may be used when the panel assembly 106 and the handle assembly 100 are assembled together and packaged for shipping or transportation. The handle member 102 is disposed in the shipping position by exerting a force on a portion of the stop member 110. In the illustrated embodiment, the force is a compressive force that is applied in a direction that is substantially normal to the plane defined by the side surface 105. The force moves the portion of the stop member 110 such that the stop member 110 does not pass through the engagement region 112 and does not contact the impeding portion 302. Thus, the stop member 110 effectively disengages from the engagement region 112, and the handle member 102 may be rotated beyond the contact region of the stop member 110 and the impeding portion 302 along the direction illustrated by the arrow 401. The shipping position illustrated in FIG. 4, allows portions of the distal end 101 (or grip region 104) of the handle member 102 to pass through the plane defined by the facing surface 103 such that less of the handle member 102 extends through the plane defined by the facing surface 103. Thus, in the shipping position, the profile of the handle member 102 is partially obscured by the side surface 105. The shipping position decreases the chance that the handle member 102 may be damaged during shipping or transportation, and reduces the external dimensions of the panel assembly 106 and the handle assembly 100 when the two assemblies are connected or linked together.

Figure 5:
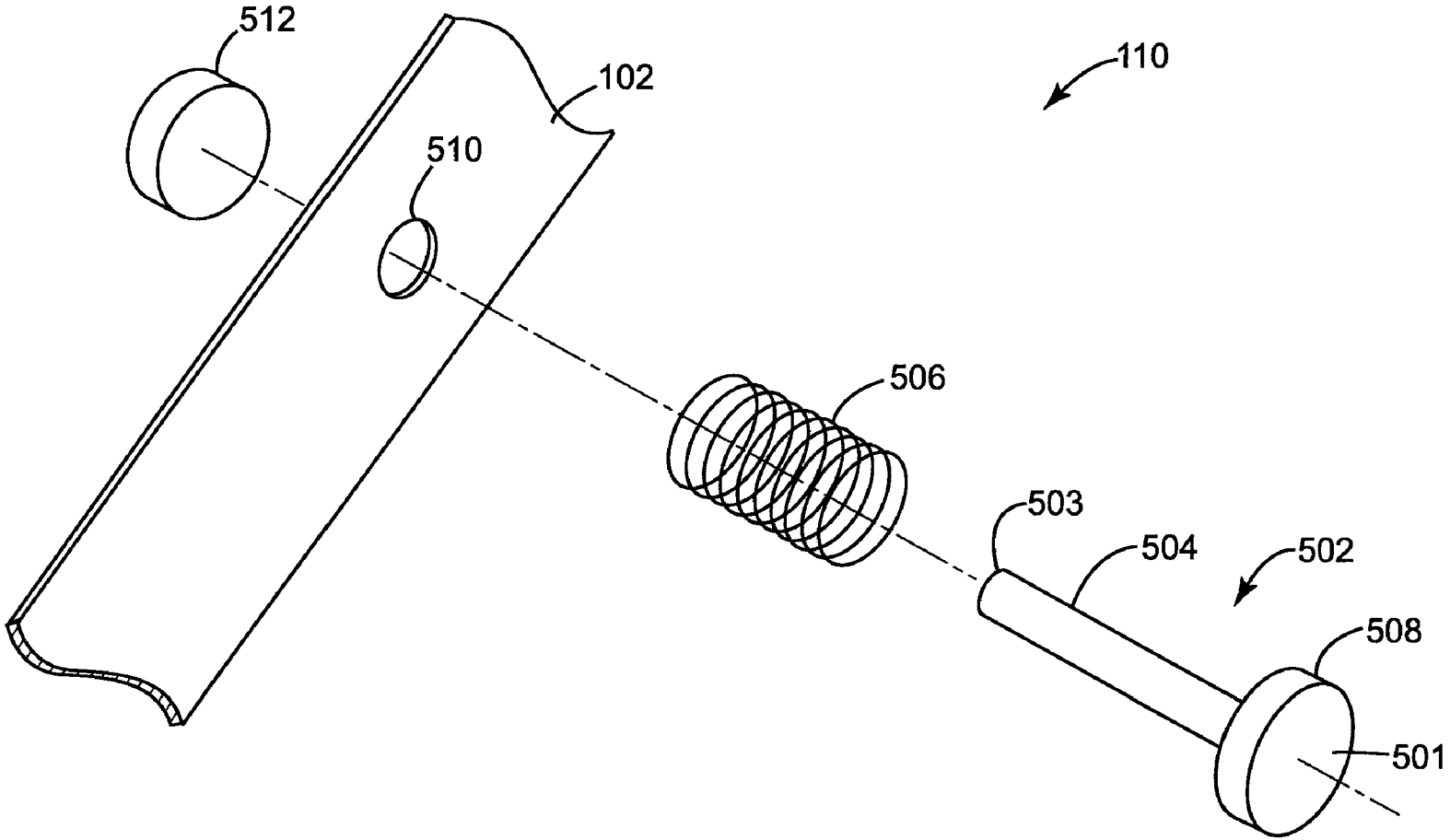
FIG. 5 illustrates an exploded view of an exemplary embodiment of the stop member of FIG. 1.

FIG. 5 illustrates an exploded view of an exemplary embodiment of the stop member 110. In this regard, the stop member 110 includes a stop portion 502 that includes a shaft portion 504, a first distal end 501, and an opposing second distal end 503. The stop portion 502 includes a first impeding portion 508 arranged at the first distal end 501. A biasing member 506 that may include, for example, a spring is disposed around the shaft portion 504 of the stop portion 502. The second distal end 503 of the stop portion 502 is sized to slidably engage and pass through an engagement region 510 of the handle member 102. A second impeding portion 512 is arranged at the second distal end 503 of the stop portion 502. When assembled, an end of the biasing member 506 contacts the handle member 102 and an opposing end of the biasing member 506 contacts the first impeding portion 508. The biasing member 506 exerts an expansive force on the handle member 102 and the first impeding portion 508 of the stop portion 502. Though the illustrated embodiment depicts the shaft portion 504 as a cylindrically shaped shaft, the shaft portion 504 may have any appropriate geometrical profile that may include, for example, a tapered shape or a rectangular shape. The engagement region 510 may include any shape that may correspond to the size and shape of the shaft portion 504. Though the second impeding portion 512 is depicted as a separate component of the stop member 110, the second impeding portion 512 may be fabricated from the second distal end 503 of the stop portion 502 by a fabrication method such as, for example, a stamping or compression method that forms the second impeding portion 512 as an integral and connected portion of the stop portion 502. In an alternate embodiment, the second impeding portion 512 may include a pin or other fastener arrangement that may be connected to the second distal end 503 of the stop portion 502 during assembly.

Figure 6:
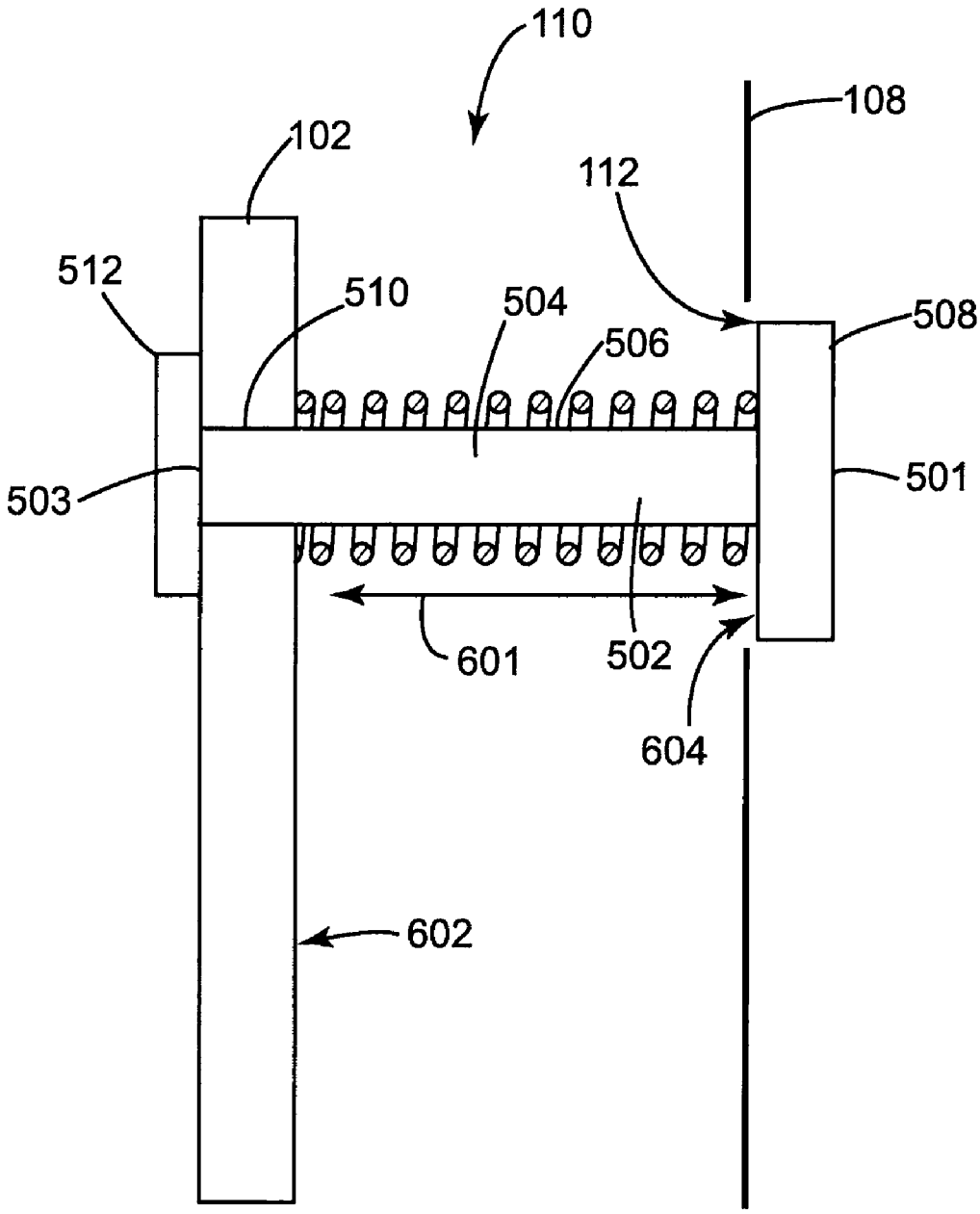
FIGS. 6-7 illustrate top partially cut-away views of the engagement of the stop member of FIG. 5 with the engagement region defined by the pouch assembly.
Figure 7:
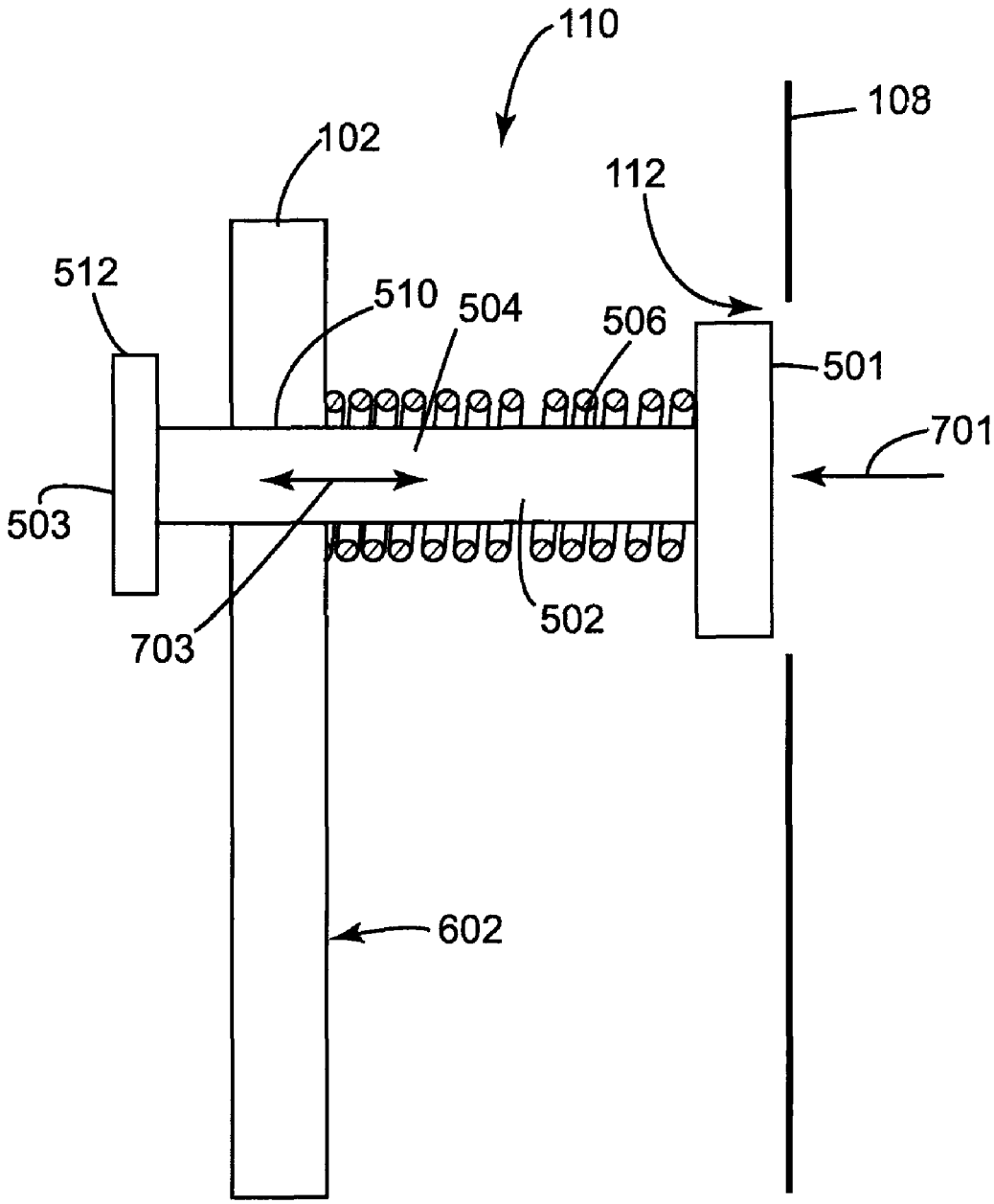

FIGS. 6-7 illustrate top partially cut-away views of the stop member 110 engagement with the engagement region 112 defined by the guide member 108. Referring to FIG. 6, the stop member 110 is shown in an operational position (such as the positions described above in FIGS. 2 and 3, or any position along an arcuate path between the positions described in FIGS. 2 and 3), where a portion of the stop member 110 engages and passes at least partially through the engagement region 112 of the guide member 108. The biasing member 506 exerts an expansive force along the line 601 to the surface 602 of the handle member 102 and the surface 604 of the stop portion 502.

Referring to FIG. 7, a force illustrated by the arrow 701 has been applied to the stop portion 502 such that the biasing member 506 compresses and portions of the stop portion 502 slidably passes through the engagement region 510 of the handle member 102 along a longitudinal axis 703 of the stop portion 502. The first distal end 501 of the stop portion 502 passes through the engagement region 112 of the guide member 108. In operation, the exertion of the force along the arrow 701 by an operator along with the exertion of a rotational force or torque on the handle member 102 allows the handle member 102 to rotate without the stop member 110 contacting the impeding portion 302 (of FIG. 3) of the guide member 108 into the shipping position described above in FIG. 4. The longitudinal axis 703 of the stop portion 502 is arranged substantially parallel to the axis of rotation 111 (of FIG. 1).

Figure 8:
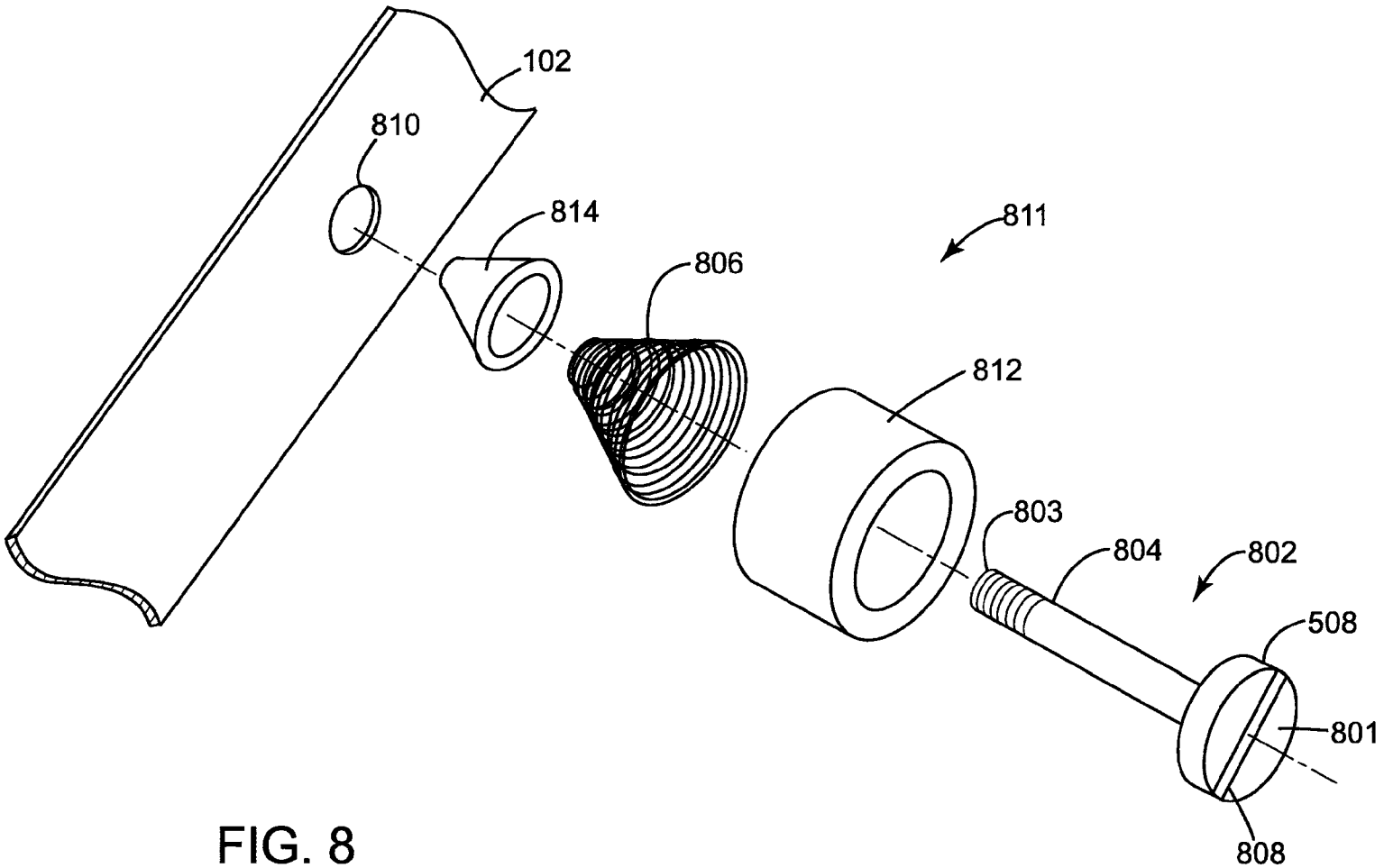
FIG. 8 illustrates an exploded view of an alternate exemplary embodiment of the stop member of FIG. 1.

FIG. 8 illustrates an exploded view of an alternate exemplary embodiment of the stop member 811 that is arranged in a similar position on the handle member 102 as the embodiments described above. In this regard, the stop member 811 includes a stop portion 802 that includes a shaft portion 804, a first distal end 801, and an opposing second distal end 803. The stop portion 802 includes a first impeding portion 808 arranged at the first distal end 801. A biasing member 806 that may include, for example, a cylindrically shaped or conically shaped spring is disposed around the shaft portion 804 of the stop portion 802. The second distal end 803 of the stop portion 802 is sized to engage an engagement region 810 of the handle member 102. The engagement region 810 may include a threaded surface that engages a threaded portion of the second distal end 803 of the stop portion 802. A bushing member 812 engages the stop portion 802. The illustrated embodiment may include an impeding member 814 that may be arranged between the handle member 102 and the biasing member 806. Alternative embodiments may not include the impeding member 814.

Figure 9:
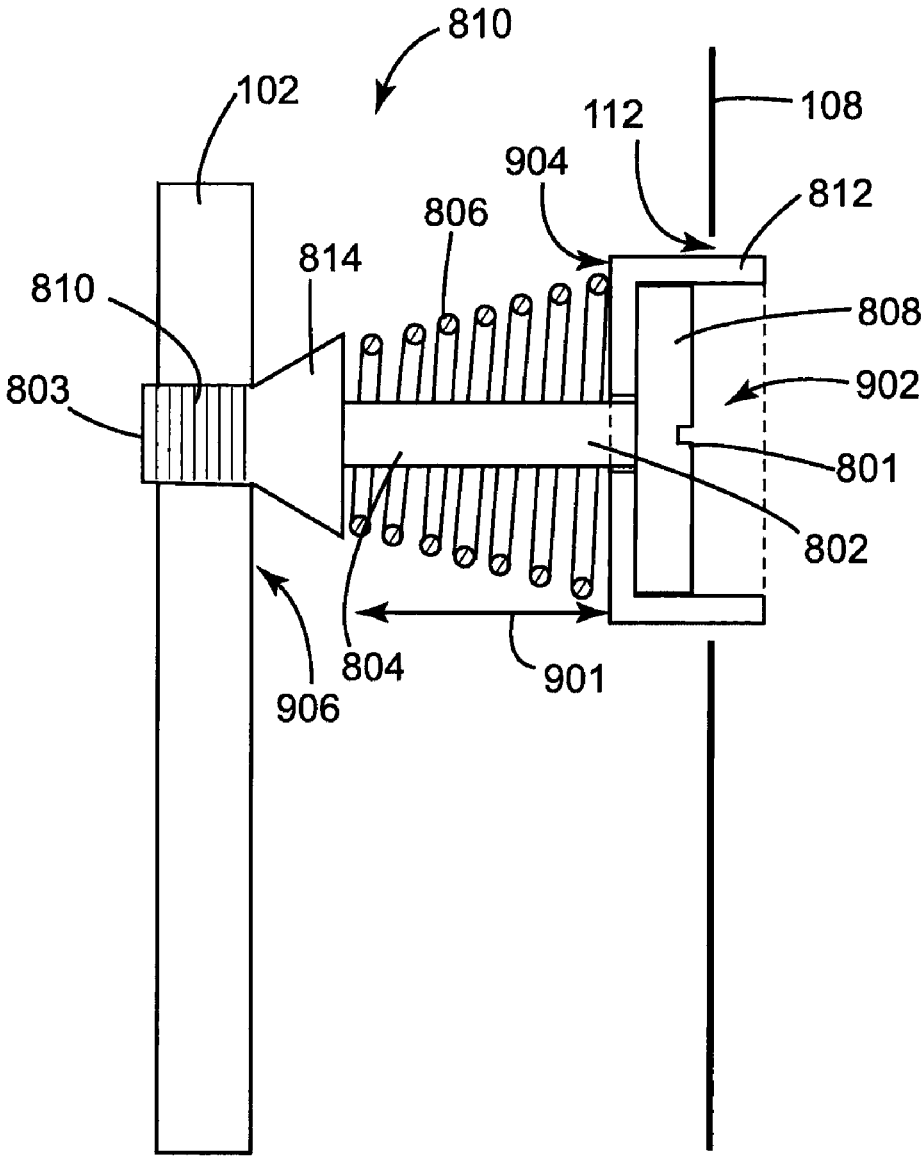
FIGS. 9-10 illustrate top partially cut-away views of the engagement of the stop member of FIG. 8 with the engagement region defined by the pouch assembly.
Figure 10:
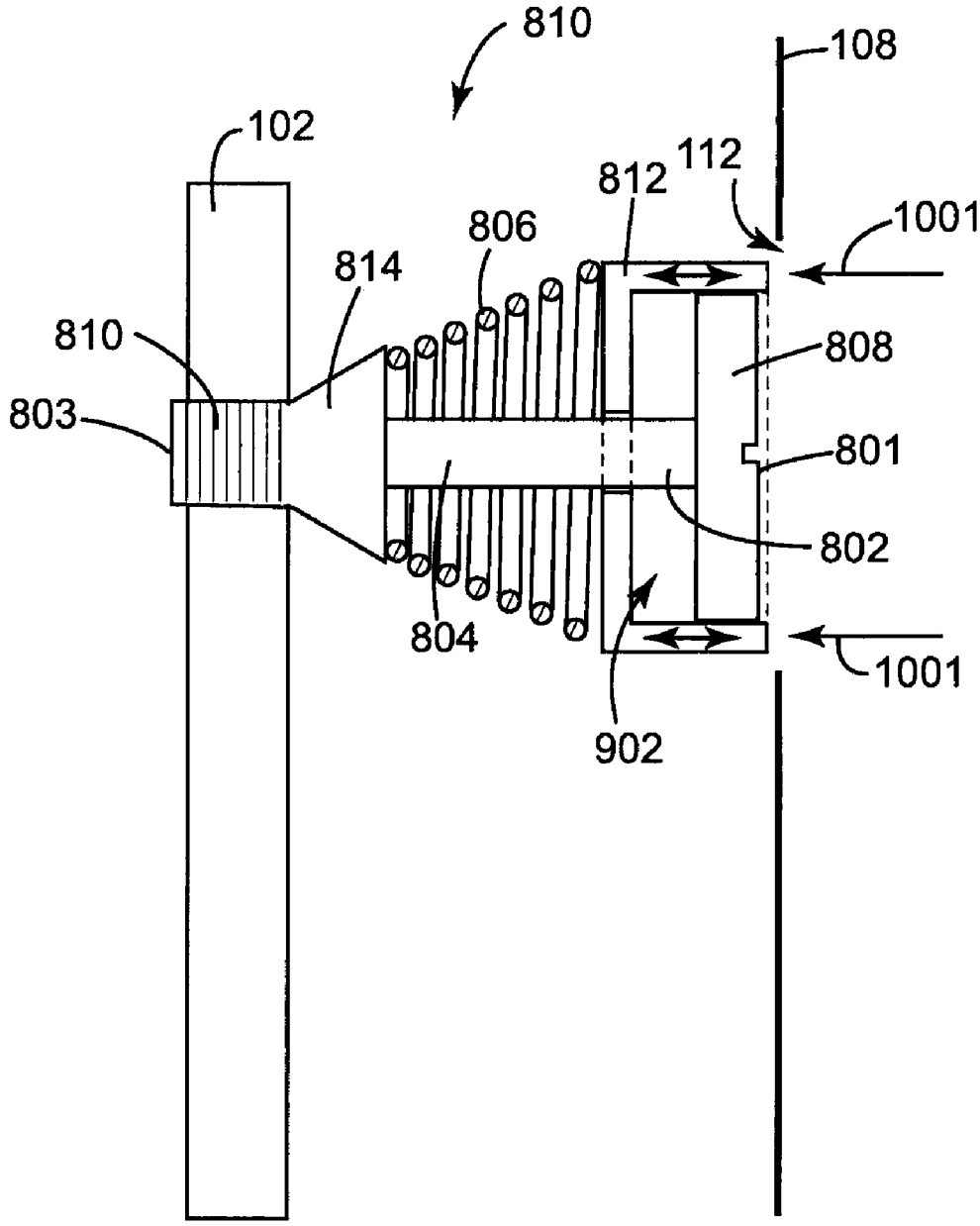

FIGS. 9-10 illustrate top partially cut-away views of the stop member 811 engagement with the engagement region 112 defined by the guide member 108. Referring to FIG. 9, the stop member 811 is shown in an operational position (such as the positions described above in FIGS. 2 and 3, or any position along an arcuate path between the positions described in FIGS. 2 and 3), where a the bushing member 812 of the stop member 811 engages and passes at least partially through the engagement region 112 of the guide member 108. The biasing member 806 exerts an expansive force along the line 901 to the handle member 102 (via the impeding member 814) and the surface 904 of the bushing member 812. The bushing member 812 is retained by the first impeding portion 808 that is disposed in the cavity 902 partially defined by the bushing member 812. Though the illustrated embodiment includes the impeding member 814, in alternate embodiments the impeding member 814 may be omitted, and the biasing member 806 exerts the expansive force on the surface 906 of the handle member 102.

Referring to FIG. 10, a force illustrated by the arrows 1001 has been applied to the bushing member 812 such that the biasing member 806 compresses and the bushing member 812 slidably moves along the shaft portion 804 of the stop portion 802. The bushing member 812 passes through the engagement region 112 of the guide member 108. In operation, the exertion of the force along the arrows 1001 by an operator along with the exertion of a rotational force or torque on the handle member 102 allows the handle member 102 to rotate without the stop member 811 contacting the impeding portion 302 (of FIG. 3) of the guide member 108 into the shipping position described above in FIG. 4. The longitudinal axis of the stop portion 804 is arranged substantially parallel to the axis of rotation 111 (of FIG. 1).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An apparatus, comprising:
- a linkage having an axis of rotation;
- a handle member being linked to the linkage;
- a stop member connected to the handle member, wherein the stop member comprises:
  - a stop portion having a first impeding portion arranged at a first distal end of the stop portion and a second impeding portion arranged at a second distal end of the stop portion, the stop portion including a shaft portion configured to slidably engage an orifice defined by the handle member; and
  - a biasing member configured to contact the handle member and the first impeding portion; and
- a guide member defining an engagement region aligned with the stop member such that a portion of the stop member is configured to engage the engagement region.

2. The apparatus of claim 1, wherein the apparatus includes a panel assembly, and the handle member is disposed between a portion of the panel assembly and a portion of the guide member.

3. The apparatus of claim 1, wherein the biasing member is configured to exert an expansive force on the handle member and the first impeding portion.

4. The apparatus of claim 1, wherein the stop member comprises:
- a bushing member configured to engage the stop portion; and
- a biasing member configured to contact the handle member and the bushing member.

5. The apparatus of claim 4, wherein the biasing member is configured to exert an expansive force on the handle member and the bushing member.

6. The apparatus of claim 1, wherein the engagement region defined by the guide member defines an arcuate shape.

7. An apparatus comprising:
- a linkage having an axis of rotation;
- a handle member being linked to the linkage, wherein the handle member defines an orifice;
- a guide member defining an engagement region; and
- a stop member linked to the handle member, the stop member defining longitudinal axis, the stop member including a biasing member that is configured to exert a force on a portion of the stop member to extend the portion of the stop member to engage the engagement region, wherein the stop member comprises:
  - a stop portion having a first distal end and a second distal end;
  - a first impeding portion arranged at the first distal end of the stop portion;
  - a second impeding portion arranged at the second distal end of the stop portion, the stop portion including a shaft portion configured to slidably engage the orifice defined by the handle member; and
  - a biasing member configured to contact the handle member and the first impeding portion.

8. The apparatus of claim 7, wherein the handle member is disposed between a portion of a panel assembly and a portion of the guide member assembly.

9. The apparatus of claim 7, wherein the biasing member is configured to exert an expansive force on the handle member and the first impeding portion.

10. The apparatus of claim 7, wherein the stop member comprises:

a bushing member configured to engage the stop portion; and a biasing member configured to contact the handle member and the bushing member.

11. The apparatus of claim 10, wherein the biasing member is configured to exert an expansive force on the handle member and the bushing member.

12. The apparatus of claim 7, wherein the engagement region defined by the guide member defines an arcuate shape.

13. An apparatus comprising:

a panel having an outer surface and a region defined by the outer surface; and a handle device comprising:

a linkage having an axis of rotation, the linkage is arranged to pass through the region defined by the outer surface of the panel;

a handle member being linked to the linkage;

a stop member connected to the handle member, wherein the stop member comprises:

a stop portion having a first distal end and a second distal end;

a first impeding portion arranged at the first distal end of the stop portion;

a second impeding portion arranged at the second distal end of the stop portion, the stop portion including a shaft portion arranged to slidably engage the engagement region defined by the handle member; and a biasing member configured to contact the handle member and the first impeding portion; and a guide member defining an engagement region aligned with the stop member such that a portion of the stop member is configured to engage the engagement region defined by the guide member.

14. The apparatus of claim 13, wherein the guide member is connected to the outer surface of the panel.

15. The apparatus of claim 13, wherein the stop member comprises:

a bushing member engaging the stop portion; and a biasing member contacting the handle member and the bushing member.

* * * * *

UNITED STATES PATENT AND TRADEMARK OFFICE

CERTIFICATE OF CORRECTION

PATENT NO. : 8,381,614 B1
APPLICATION NO. : 13/297705
DATED : February 26, 2013
INVENTOR(S) : Somalingayya et al.

It is certified that error appears in the above-identified patent and that said Letters Patent is hereby corrected as shown below:

In the Specifications:

In Column 1, Line 51, delete "DRAWING" and insert -- DRAWINGS --, therefor.

In Column 2, Line 67, delete "impeding member 302" and insert -- impeding portion 302 --, therefor.

In Column 5, Line 56, delete "804" and insert -- 802 --, therefor.

Signed and Sealed this
Twenty-eighth Day of May, 2013

Teresa Stanek Rea
*Acting Director of the United States Patent and Trademark Office*